United States Patent [19]

Hanson et al.

[11] 4,139,450

[45] Feb. 13, 1979

[54] SOLVENT EXTRACTION OF TAR SAND

[75] Inventors: Donald O. Hanson; Fred T. Sherk, both of Bartlesville, Okla.

[73] Assignee: Phillips Petroleum Company, Bartlesville, Okla.

[21] Appl. No.: 841,512

[22] Filed: Oct. 12, 1977

[51] Int. Cl.[2] ..... C10G 1/04

[52] U.S. Cl. ..... 208/11 LE

[58] Field of Search ..... 208/11 LE

[56] References Cited

U.S. PATENT DOCUMENTS

| | | | |
|---|---|---|---|
| 3,161,581 | 12/1964 | Tiedje et al. | 208/11 LE |
| 3,553,099 | 1/1971 | Savage et al. | 208/11 LE |
| 3,808,120 | 4/1974 | Smith | 208/11 LE |
| 3,929,193 | 12/1975 | Duke | 208/11 LE |

*Primary Examiner*—Herbert Levine

[57] ABSTRACT

An extraction process for recovering bitumens from tar sands in which the tar sand is mixed with a hot hydrocarbon solvent, for example, toluene, in order to evaporate substantially all the water contained in the tar sands. The tar sands-solvent mixture is then separated into two phases of fine and coarse sand. Two centrifuging steps are then used to recover the bitumen from the fine sand phase.

9 Claims, 2 Drawing Figures

SOLVENT EXTRACTION OF TAR SAND

SUMMARY OF THE INVENTION

This invention relates to the recovery of bitumens from tar sands. In another aspect, it relates to a solvent extraction process for recovering bitumen from tar sands. In another aspect, it relates to the use of an aromatic solvent in extracting bitumen from tar sands. In yet another aspect, this invention relates to the use of a water-free process for extracting bitumen from tar sands. In yet another aspect, it relates to the use of a hot hydrocarbon solvent to evaporate substantially all the water in the tar sands in an initial mixing step. In yet another aspect, it relates to the removal of substantially all the water in the tar sands by stripping with solvent vapor. In another aspect, it relates to the use of a hot aromatic solvent. In still another aspect, it relates to the use of toluene as the aromatic solvent. In still another aspect, this invention relates to the recycling of the recovered, hot hydrocarbon solvent to the initial mixing step to provide some of the heat necessary for raising the temperature of the tar sands sufficiently to evaporate substantially all the water contained in the tar sands.

In the extraction of bitumen from tar sands, certain tar sands are not amenable to treatment by the well-known "hot water process." The major problems encountered in the recovery of bitumens from tar sands, such as those from the Edna, California, region, by displacement with aqueous, alkaline media are that the recovery is highly dependent on technique and produces a floc of oil and silt suspended in water from which the oil must be separated.

It would be very advantageous, therefore, to avoid the formation of such oil-water-silt suspensions by not adding water to the tar sands if possible. One solution is that of using an aromatic solvent such as toluene in the extraction process instead of water. U.S. Pat. No. 3,553,099 discloses such use of an aromatic solvent for the extraction of tar sands, however, water is subsequently added to the system in an elutriation zone. The addition of water, as well as water already in the tar sands, may cause problems due to the formation of oil-water-silt suspensions. The art in the field of tar sands processing is replete with proposed methods for separating the difficult-to-handle suspensions, emulsions, flocs and/or froths of tar, fine sand (silt), water and hydrocarbon solvent which render many processes uneconomical.

The present invention, however, solves the problems by first evaporating substantially all the water contained in the tar sands and then maintaining a "dry" or "water-free" process. This is accomplished by initially mixing the tar sand with hot hydrocarbon solvent thereby evaporating the water, extracting and recovering the bitumen and employing hydrocarbon solvent, not water, in the sand separation steps which follow. The hydrocarbon solvent initially mixed with the tar sand is usually in the vapor phase with some of the solvent vapor being condensed upon supplying heat energy to the tar sand feed sufficient to vaporize the water, and with the water vapor then being removed by vapor phase stripping by the noncondensed solvent vapor. Aromatics or aromatic solvent mixtures are preferred over paraffinic fractions since the bitumens are more soluble in the aromatics. The aromatic solvent used is preferably one that boils in the range of 180°-280° F. (82°-138° C.) in order to heat the tar sands to a temperature of about 200° F. (93° C.) to assist the vaporization removal of water. A preferred example of such an aromatic solvent is toluene.

In a specific embodiment, the present invention can also be modified to conserve heat by recycling hot, recovered aromatic solvent vapor and liquid to the initial contacting or mixing step so that the heat in the recovered solvent vapor and liquid can be used to aid the evaporation of the water contained in the tar sands.

There are some tar sands, however, such as the Athabasca tar sands described in U.S. Pat. No. 3,117,922, where the initial removal of water as contemplated in the present invention is a usable process, but would not be the most desirable technique of extraction to employ. The Athabasca tar sands have fines, clays, and other silt particles contained in water envelopes which surround individual grains of water-wet sand particles. Each of these water envelopes containing silt particles is in turn surrounded with a film of bitumen which encases the water envelopes. Further amounts of bitumen partially fill the voids between individual sand particles. It is, therefore, according to U.S. Pat. No. 3,117,922, desirable to not rupture these water envelopes in order to avoid the problems of water-oil emulsions and silt-oil emulsions which would occur if the water envelopes were ruptured thereby permitting the water and silt to mix with the bitumen. A technique other than that of the instant invention, therefore, would likely be preferred for Athabasca tar sands.

After the initial step of removing water by stripping with hot hydrocarbon solvent, and extracting the bitumen, the tar sands-solvent mixture is separated finally into a bitumen product, coarse sand and fine sand. Hydrocarbon solvent is used in separation steps to extract any remaining bitumen from the fine and the coarse depleted sands. The fine sand, however, is subjected to two consecutive centrifugings in order to separate substantially all the bitumen extracted from the fine sand. The hot hydrocarbon solvent can then be removed by vaporization from the bitumen and recycled as hot vapor to the initial contacting (water stripping) step as the principal source of heat for raising the temperature of the tar sands and evaporating water therefrom, thereby practicing thermal economy.

An object of the present invention, therefore, is to provide an improved process for extracting bitumen from tar sands.

Another object is to provide an improved process for recovering bitumen from tar sands such as those located and mined in the Edna, California, region.

Another object is to provide an improved method for removing water from tar sands.

Yet another object is to provide a method for rendering an extraction process for extracting bitumen from tar sands substantially water-free.

Yet another object is to provide a more thermally-efficient solvent process for extracting bitumen from tar sands.

Other objects, aspects, and the several advantages of this invention will be apparent to those skilled in the art upon a study of this disclosure, the drawings, and the appended claims.

DETAILED DESCRIPTION OF THE INVENTION

The invention pertains to an extraction process for recovering bitumen from tar sands. The invention may be better understood by reference to the attached FIGS. 1 and 2 upon which are schematically depicted illustrated embodiments of the invention. The following embodiments are not intended to limit the invention in any way and are only given for illustration.

Figure 1:
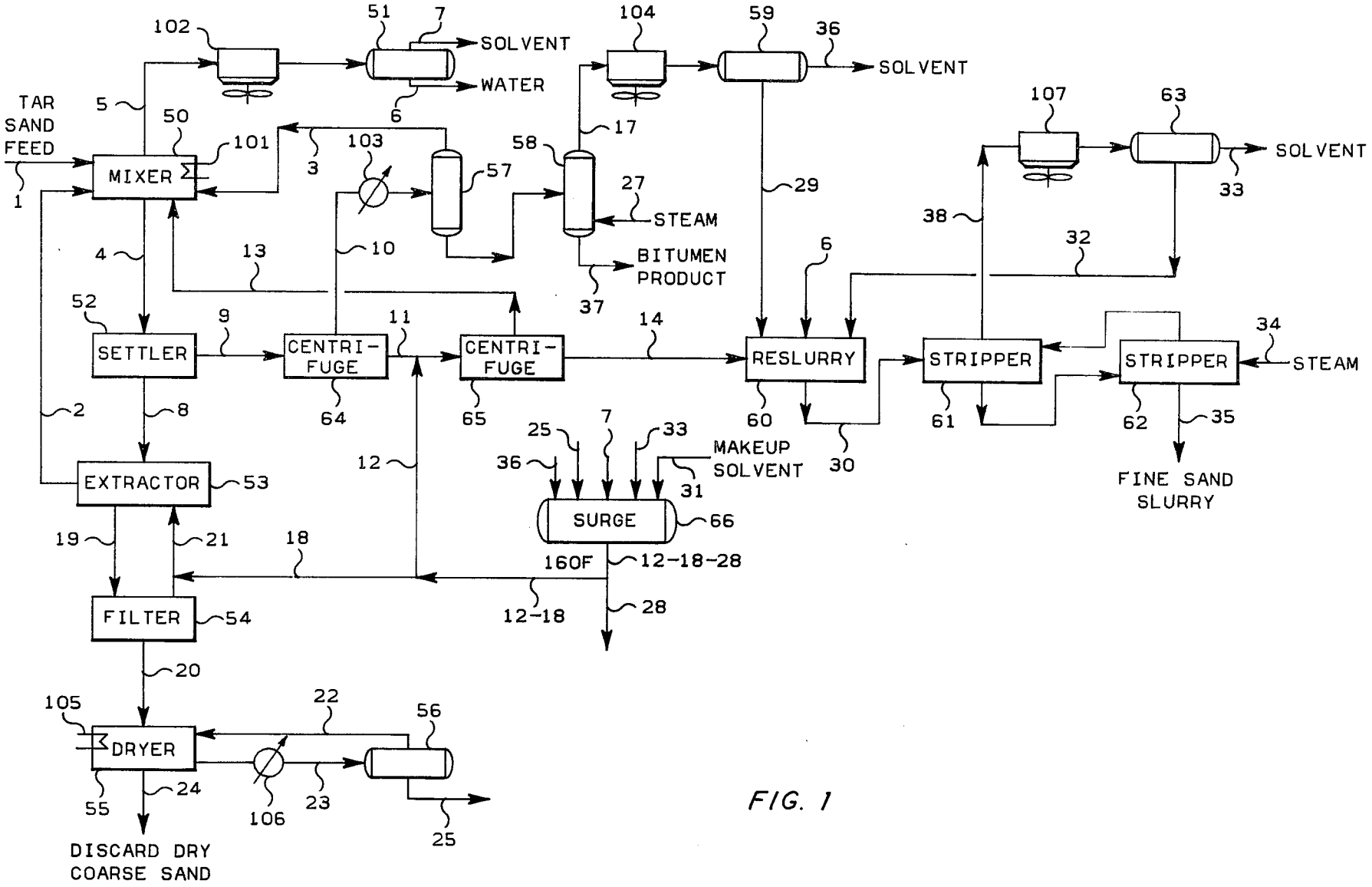
FIG. 1 illustrates a typical embodiment of the invention.

FIG. 1 illustrates a typical embodiment of the instant invention. Tar sand 1 is mixed with hot, recycle hydrocarbon solvent 3 in mixer 50. The thermal energy from the hot hydrocarbon solvent raises the temperature of the tar sand to a point sufficient to evaporate substantially all of the water contained in the tar sand. A heat exchanger 101 can provide additional heat energy as required. The temperature to which the tar sand temperature is usually raised is about 200° F. (93° C.). This temperature is sufficient for assuring that substantially all of the water contained in the tar sand is driven off as vapor. The water in the tar sand is driven off with an equimolar quantity of hydrocarbon solvent as vapor overhead 5 which is passed through heat exchanger 102 for condensation and to separation tank 51 where the liquid water 6 is separated from the liquid hydrocarbon solvent 7.

The hydrocarbon solvent of the instant invention may be aromatic, naphthenic or paraffinic in character although an aromatic solvent or a highly aromatic solvent mixture is preferred since the bitumens are generally more soluble in aromatic hydrocarbons than in other, more saturated, hydrocarbons. Suitable aromatic solvents are preferably high in aromatics for good solvent power and boil in the range of about 180°–280° F. (82°–138° C.) to facilitate removal of any solvent residue from the spent sand. Examples of such suitable aromatic solvents are xylene and toluene.

The initial mixing of the tar sand with hot hydrocarbon solvent, heated sufficiently to evaporate substantially all the water in the tar sand, allows for the bitumen extraction to be a "dry process." One of the advantages of the "dry process" is that it expedites the extraction of bitumen while avoiding the formation of oil-silt-water suspensions in the final processing steps. Furthermore, the process remains dry by using the hydrocarbon solvent, instead of water, for the elutriation and separation steps. It is not until the final fine sand and bitumen washing treatments that water is used directly in the process. By then, however, substantially all the components have been separated and the water does not cause difficult-to-break suspension problems.

The remaining mixture 4 of sand, bitumen, and hydrocarbon solvent then passes from mixer 50 to settler 52. The mixture is allowed to settle therein to obtain an overflow 9 containing mostly fine solids in solvent-bitumen admixture and an underflow 8 containing mostly coarse solids in association with less liquid. The removal of the fines from the coarse solids adds to the efficiency of the process as it allows subsequent filtration of the coarse sand to take place at feasible rates. The underflow 8 is extracted by warm hydrocarbon solvent in a countercurrent contacting device 53. The device can be either a number of continuous thickeners in series, or, preferably a vertical, multi-stage extractor such as the Bonotto extractor (Perry-Chemical Engineer's Handbook, 5th Ed., pp. 19–43). The countercurrent extractor serves both to extract bitumen from the sand and to remove fine sands from the underflow 8. The extracted fine sand and bitumen in solvent can be returned by stream 2 to mixer 50.

The countercurrent extractor underflow 19, which is essentially free of fines, is either filtered in 54 or centrifuged to obtain a partially dried coarse sand 20 and a filtrate 21 to which is added warm liquid solvent 18 which is returned to the countercurrent extractor. The coarse sand 20 is passed to a dryer 55 where the sand is dried (solvent evaporated therefrom) with a nitrogen gas purge 22. The coarse dry sand 24 is then removed and discarded. Vaporized hydrocarbon solvent is passed via 23 and heat exchanger 106 to separator 56 where the hydrocarbon solvent 25 is removed from the gas. The nitrogen is then recycled via 22, employing compression means not shown in the interests of brevity.

The settler 52 overflow 9 is passed to centrifuge 64, which can be a solid bowl centrifuge, and is centrifuged to yield an overflow, containing the product bitumen in solvent, conduit 10. The product bitumen overflow 10 is then passed through heat exchanger 103 and then flashed in tank 57. The hot hydrocarbon solvent vapor removed from the bitumen is recycled via 3 to mixer 50, whereas the flashed bitumen is then passed to steam stripper 58. The residual hydrocarbon solvent is stripped by steam 27 from the bitumen to obtain bitumen product 37. The stripped hydrocarbon solvent is then passed via 17, through condenser 104, to phase separation tank 59 where the solvent and water are separated into streams 36 and 29, respectively.

The direct recycling of the hot hydrocarbon solvent vapor to the mixer makes the process more energy-efficient. Instead of heating fresh toluene to a temperature sufficient to vaporize water from the tar sand, the hot hydrocarbon solvent vapor with warm hydrocarbon solvent-bitumen-fine sand liquid stream 2 is utilized to provide heat for the evaporation process, as well as providing a substantial portion of the hydrocarbon solvent for the "dry" extraction process. Although the hot recycle hydrocarbon solvent vapor provides the major portion of the heat for raising the sand temperature and evaporating water, any additional heat energy needed can be added by a heat exchange coil 101.

The underflow from centrifuge 64 via 11 is reslurried with fresh toluene 12 and is again centrifuged in centrifuge 65 for further bitumen recovery. The overflow of centrifuge 65, comprising primarily dilute bitumen in solvent, is recycled via 13 to mixer 50. The fine sand underflow 14 is reslurried, this time with water 6, 29 and 32, in tank 60. The fine sand slurry 30 is then stripped by steam 34 of any residual toluene in a pair of contactors, 61 and 62, operating in counterflow series, with the residual hydrocarbon solvent being recovered at 33 from steam condensate 32 after stream 38 is condensed in 107 and phase separated in 63. The fine sand slurry is recovered and discarded at 35.

As is well known in solvent extraction processes, a high degree of solvent recovery must be maintained to operate in an economic fashion. It is to be noted that both fine and coarse sand (tailings) products are well stripped of residual solvent as is the bitumen product, by means of more volatile gases, nitrogen, and steam. Therefore liquid toluene (or other) solvent, recovered by vaporization-condensation-separation steps in which further heat economy may be practiced, is recycled warm via streams 7, 25, 33, and 36 to surge vessel 66 for reuse as streams 12 and 18. A portion 28 of the combined stream 12-18-28 (solvent pumping means not being shown) may be repurified as desired by methods such as distillation (not shown), and makeup toluene may be added to surge vessel 66 via 31 to compensate for unavoidable solvent losses.

In further economical processing, recovered water, that from initial drying of the tar sand, stream 6, from steam stripping of bitumen product, stream 29, and from steam stripping of fine sand, stream 32, are all recycled to the water reslurry operation 60, thereby being both conservative of water and further preventing loss of water-soluble toluene solvent if liquid, recycled water were discharged directly. Obviously, for both plant design and operational purposes, a water balance must be maintained, therefore it is contemplated that the water entering the plant via the tar sand feed 1 and by the stripping steam streams 27 and 34, in excess of the reslurry 60 requirement, will be discharged, preferably with clean-up for reuse as steam generator feed water, thus a steam plant (not shown) is considered to be a part of a large scale plant as well.

TABLE

Illustrative Embodiment Figure #1
Approximate Flow Rates of Streams:

| | Material | | | | | | | |
|---|---|---|---|---|---|---|---|---|
| | Tar Sand | | Bitumen | | Water | | Toluene Solvent | |
| Streams | a | b | a | b | a | b | a | b |
| 1 | 1558 | 706 | 171 | 78 | 171 | 78 | | |
| 2 | 100 | 45 | 165 | 75 | | | 935.8 | 425 |
| 3 | | | | | | | 324.2 | 147 |
| 4 | 1658 | 751 | 353 | 160 | | | 705 | 320 |
| 6 | | | | | 171 | 78 | | |
| 7 | | | | | | | 878 | 398 |
| 9 | 156 | 71 | 186 | 82 | | | 372 | 169 |
| 10 | 0.8 | 0.4 | 166 | 75 | | | 332 | 151 |
| 12 | | | | | | | 340 | 154 |
| 13 | | | 17 | 8 | | | 323 | 147 |
| 14 | 155.2 | 70 | 3 | 1.4 | | | 57 | 26 |
| 18 | | | | | | | 781 | 354 |
| 19 | 1402 | 636 | 5.6 | 2.5 | | | 494 | 224 |
| 20 | 1402 | 636 | 2 | 0.9 | | | 177 | 80 |
| 24 | 1402 | 636 | 2 | 0.9 | | | 1.4 | 0.6 |
| 25 | | | | | | | 175.6 | 80 |
| 27 | | | | | 1.64 | .74 | | |
| 28 | | | | | | | 0.8 | 0.4 |
| 29 | | | | | 1.64 | .74 | | |
| 30 | 15 | 7 | 3 | 1.4 | 214.64 | 97 | 57 | 26 |
| 31 | | | | | | | 2.96 | 1.3 |
| 32 | | | | | 32 | 14.5 | | |
| 33 | | | | | | | 56.84 | 26 |
| 34 | | | | | 72.5 | 33 | | |
| 35 | 156 | 71 | 3 | 1.4 | 329 | 149 | 0.16 | .07 |
| 36 | | | | | | | 8.4 | 3.8 |
| 37 | 0.8 | 0.4 | 166 | 75 | | | 0.2 | .09 |

a In thousands of pounds per hour
b In thousands of kilograms per hour

| | Heat Transferred | |
|---|---|---|
| Heat Exchangers | Heat Transferred Million BTU/ Hour | Heat Transferred K Joule $\times 10^6$/ Hour |
| 101 | 311 | 328 |
| 102 | 329 | 348 |
| 103 | 96 | 101 |
| 104 | 3.2 | 3.4 |
| 105 | 25 | 26 |
| 106 | 7.2 | 7.6 |
| 107 | 52.8 | 55.7 |

| | Temperature of Contents | |
|---|---|---|
| | ° F | ° C |
| Mixer 50 | 200 | 93 |
| Separation Tank 51 | 160 | 71 |
| Settler 52 | 195 | 91 |
| Dryer 55 | 250 | 121 |
| Flashing Tank 57 | 400 | 204 |
| Steam Stripper 58 | 400 | 204 |
| Separation Tank 59 | 160 | 71 |
| Reslurrying Tank 60 | 165 | 74 |
| 1st Contactor 61 | 200 | 93 |
| 2nd Contactor 62 | 230 | 110 |
| Separation Tank 63 | 160 | 71 |
| Extractor 53 | 180 | 82 |

The illustrative conditions, i.e., flow rates in thousands of pounds/hour, rate of heat absorbed, temperature, and pressure, applicable to the foregoing illustrative embodiment are summarized in the table. The hydrocarbon solvent chosen for the illustration is toluene.

Certain modifications of the invention will become apparent to those skilled in the art, and the illustrative details enclosed are not to be construed as imposing unnecessary limitations on the invention.

Figure 2:
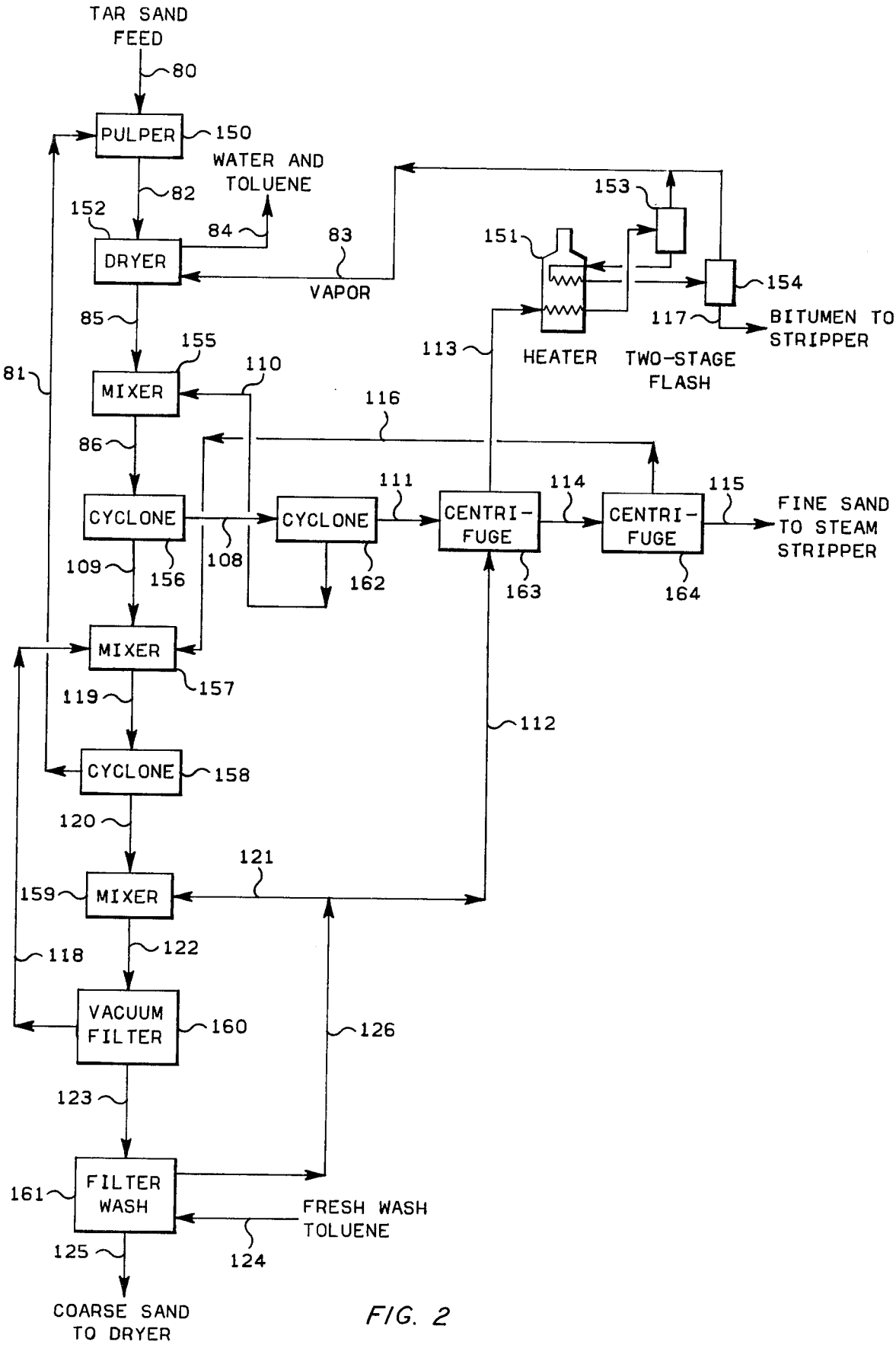
FIG. 2 illustrates the preferred embodiment of the invention.

FIG. 2 illustrates a preferred embodiment of the invention. Tar sand 80 is fed to a pulper 150 along with a solvent-bitumen mixture 81 (described below). The pulper can be a rotating drum type and the feed ratio of tar sand to solvent-bitumen mixture employed is preferably about 1:2. The solvent chosen for this example also is toluene; however, it is to be emphasized, as in the above illustrative embodiment, that the process is not restricted to the use of a single aromatic hydrocarbon but that the hydrocarbon solvent is preferably high in light aromatics concentrations of which toluene is preferred.

The pulp is then passed by way of 82 to dryer 152. Water is removed from the tar sand in the dryer by stripping with toluene vapor 83 from the bitumen flash drums 153 and 154. Any well-known means in the art of introducing the stripping toluene vapor into the dryer can be employed. One example of a suitable means is that of a vapor distributor such as a sparger. An auxiliary heating coil (not shown) in dryer 152 can be used to provide any additional heat necessary to raise the temperature of the pulp sufficiently to evaporate off substantially all the water. A pulp temperature of about 200° F. (93° C.) is commonly utilized when toluene is the principal aromatic solvent. The overhead 84 of the dryer is then passed to recovery steps as previously described.

Dry solvent-sand mixture is passed by 85 through a three mixer-three separator process consisting of mixing vessels 155, 157, and 159 and cyclone separators 156 and 158 and vacuum filter 160. Tar, bitumen, and other carbonaceous materials are solvent extracted from the sand in mixer 155 following which, via line 86, liquid phase containing fine sand is separated by virtue of the fractionating power of the cyclone 156. The overflow 108 of cyclone 156 is, therefore, primarily fine sand and bitumen solution-dispersion whereas the underflow 109 is primarily solvent-wet coarse sand which is fed to mixer 157. Cyclone 162 aids in reducing the concentration of sand in the overflow 108 of cyclone 156 by further separating fine sand through recycling its underflow 110 to mixer 155.

The removal of the fines from the tar sand allows for an efficient separation process as it allows filtration of the coarse sand by vacuum filters 160 and 161 at feasible rates.

The bitumen concentrate 111, the overflow from cyclone 162, is then centrifuged in centrifuge 163 and the separated solids washed by toluene from conduit 112, described below. Preferably a MERCO solid bowl centrifuge is used. The overflow 113 is then heated in furnace 151 and flash-vaporized in two stages 153 and 154 to yield the hot recycle toluene vapor which is passed via 83 to the dryer 152, and the bitumen product which is passed by way of 117 to a stripping step, not shown, to remove any residual toluene as before.

The underflow of centrifuge 163 is then passed via conduit 114 to a second centrifuge 164, preferably a solid-bowl scroll-type centrifuge. The overflow 116 from second centrifuge 164 is then passed via 116 to mixer 157 whereas the underflow, comprising toluene-wet fine sand, is passed via 115 to fine sand reslurry and steam stripping steps as before.

The coarse sand from cyclone 156 is passed by way of 109 to mixer 157 where it is mixed with the overflow stream 116 from centrifuge 164 and recycle solvent stream 118 from vacuum filter 160, described below. The slurried mixture is then passed via 119 to cyclone 158. The overflow stream 103 from cyclone 158, consisting of bitumen and fine sand carried by toluene, is recycled to pulper 150 as the initial extracting solvent for the tar sand feed. The underflow of cyclone 158 is then passed via conduit 120 to mixer 159 where it is reslurried with recycle solvent via conduit 121 from vacuum filter wash step 161 described below. This slurry is passed by conduit 122 to vacuum filter 160 whose filtrate is recycled to mixer 157 via conduit 118. The solvent-wet coarse sand from vacuum filter 160 is passed via conduit 123 to a second vacuum filter 161 for additional solvent extraction where the coarse sand is washed with the only fresh toluene stream added to the process by conduit 124. The washed, coarse sand is then passed via 125 to a drying step for final solvent recovery such as by a rotating steam tube dryer, not shown.

Solvent-filtrate stream 126 is recycled to mixer 159 via conduit 121 and to centrifuge 163 via conduit 112 as desired.

It will be evident to skilled process engineers studying this disclosure of methods of and apparatus for "dry" extraction of bitumen-tar from a certain type of tar sand that a number of techniques leading the high recovery of bitumen, low solvent loss and efficient, low-cost processing are included. Beyond the beneficial features pointed out for FIG. 1 and its description, FIG. 2 includes a higher degree of countercurrent contacting of coarse sand with solvent as evidenced by toluene, progressively being enriched in bitumen, recycling via streams 126, 118, and 103 to contact and extract sand containing higher bitumen concentration. The processes of both FIGS. 1 and 2 employ and cause the separation of the tar sands into fine and coarse particle size streams to which the most effective extraction conditions and equipment may be applied.

Reasonable variations and modifications are possible within the scope of the foregoing disclosure and the appended claims to the invention.

We claim:

1. A process for recovering bitumens from tar sands containing water comprising the steps of:

(a) mixing the tar sand with a hydrocarbon solvent heated sufficiently to evaporate off substantially all of the water contained in the tar sands;

(b) separating the tar sands-solvent mixture into two phases, the first a fine sand-bitumen-solvent phase, and the second a solvent wet-coarse sand phase;

(c) extracting the solvent wet-coarse sand phase with a hydrocarbon solvent in order to extract bitumen from the coarse tar sands and remove substantially all the remaining fine sand;

(d) separating the solvent from the coarse sand in the resulting coarse sand-solvent mixture of step (c);

(e) subjecting the fine sand-bitumen-solvent phase in step (b) to an initial centrifuging step to yield an overflow containing product bitumen in solvent; and (f) subjecting the fine sand fraction recovered from the bottom of the centrifuge in step (e) to a second centrifuging step to thereby remove substantially all the remaining bitumen.

2. A process as in claim 1 wherein:

the bitumen and fine sand separated in step (c) is recycled to the mixing in step (a);

the solvent separated in step (d) is recycled to the extraction in step (c);

the coarse sand separated in step (d) is dried in a steam tube dryer with a $N_2$ purge;

the fine sand separated in step (f) is slurried with water and then stripped of any residual solvent;

the overflow fraction of step (e), containing the bitumen and hydrocarbon solvent, is flashed with the recovered hot hydrocarbon solvent recycled to step (a) to provide heat for the evaporation of water and a dry bitumen product thereby recovered; and the extraction in step (c) is in a countercurrent device.

3. A process as in claim 1 wherein the hydrocarbon solvent boils in the range of 180°–280° F. (82°–138° C.) and the tar sands are heated by the aromatic solvent to a temperature of about 200° F. (93° C.).

4. A process as in claim 1 wherein said hydrocarbon solvent is aromatic.

5. A process as in claim 4 wherein said aromatic solvent is toluene.

6. A process as in claim 1 wherein said extracting in step (c) is accomplished by three mixer-settler stages which perform simultaneously the extraction of fine sand and bitumen from the tar sand feed.

7. A process for recovering bitumens from tar sands comprising the steps of:

(a) pulping the tar sands while adding an aromatic-bitumen mixture;

(b) screening the pulped product of step (a) to remove lumps;

(c) stripping water from the screened product of step (b) by adding hot aromatic solvent vapor heated sufficiently to evaporate off substantially all of the water contained in the tar sands;

(d) passing the tar sands-solvent mixture from step (c) to a mixer and then to a cyclone in order to separate said tar sands-solvent mixture into two phases, the first a fine sand-bitumen-solvent phase, and the second a solvent wet-coarse sand phase;

(e) passing the fine sand-bitumen-solvent phase of step (d) to a second cyclone;

(f) recycling the underflow from said cyclone in step (e) to said mixer in step (d);

(g) passing the overflow from said cyclone in step (e) to an initial centrifuge;

(h) passing the overflow from said centrifuge in step (g) to a flashing zone in order to flash the aromatic solvent from the bitumen and thereby recovering bitumen product and passing the flashed solvent to the stripping stage in step (c);

(i) passing the underflow from said centrifuge in step (g) to a second centrifuge to separate fine sand from any remaining bitumen and thereby recover the fine sand;

(j) passing the coarse sand-solvent wet phase from step (d) to a second mixer and then to a second cyclone whose overflow is recycled to the pulping in step (a); and (k) passing the underflow from said cyclone in step (j) to a mixer and then to a vacuum filter from which the filtered solvent is recycled to said mixer in step (j) and the remaining coarse sand is washed and passed to drying.

8. A process as in claim 7 wherein the aromatic solvent in step (c) boils in the range of 180°-280° F. (82°-138° C.) and the tar sands is heated by the solvent to a temperature of 200° F. (93° C.).

9. A process as in claim 7 wherein said aromatic solvent is toluene.

* * * * *